US006283430B1

(12) United States Patent
Schubert et al.

(10) Patent No.: US 6,283,430 B1
(45) Date of Patent: Sep. 4, 2001

(54) HORIZONTAL SOCKET HOUSING ASSEMBLY

(75) Inventors: John S. Schubert, Arlington Heights; Joellen M. Skonberg, Schaumburg, both of IL (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/559,533

(22) Filed: Apr. 28, 2000

(51) Int. Cl.[7] ..... B42F 13/00
(52) U.S. Cl. ..... 248/343; 362/382; 248/314
(58) Field of Search ..... 362/382, 404, 362/364, 365; 248/906, 343, 314

(56) References Cited

U.S. PATENT DOCUMENTS

| | | |
|---|---|---|
| 2,998,512 | 8/1961 | Duchene et al. . |
| 3,697,742 | 10/1972 | Bobrick . |
| 3,721,817 | 3/1973 | Contratto . |
| 3,872,296 | 3/1975 | Cohen et al. . |
| 4,388,677 | 6/1983 | Druffel . |
| 4,408,262 | 10/1983 | Kusmer . |
| 4,419,717 | 12/1983 | Price et al. . |
| 4,471,416 | 9/1984 | Druffel . |
| 4,566,057 | 1/1986 | Druffel . |
| 4,685,037 | 8/1987 | Akiyama et al. . |
| 4,754,377 | 6/1988 | Wenman . |
| 4,803,603 | 2/1989 | Carson . |
| 4,947,297 | 8/1990 | Druffel et al. . |
| 5,145,249 | 9/1992 | Bruckner . |
| 5,222,800 | 6/1993 | Chan et al. . |
| 5,374,812 | 12/1994 | Chan et al. . |
| 5,440,471 | 8/1995 | Zadeh . |
| 5,452,816 | 9/1995 | Chan et al. . |
| 5,550,723 | 8/1996 | Ullman . |
| 5,562,343 | 10/1996 | Chan et al. . |
| 5,588,737 | 12/1996 | Kusmer . |
| 5,662,413 | 9/1997 | Akiyama . |
| 5,673,997 | 10/1997 | Akiyama . |
| 5,746,507 | 5/1998 | Lee . |
| 5,758,959 | 6/1998 | Sieczkowski . |
| 5,800,050 | 9/1998 | Leadford . |
| 5,826,970 | 10/1998 | Keller et al. . |
| 5,857,766 | 1/1999 | Sieczkowski . |
| 5,957,573 | 9/1999 | Wedekind et al. . |

FOREIGN PATENT DOCUMENTS

| | | |
|---|---|---|
| 0 561 483 A1 | 9/1993 | (EP) . |
| 0 660 036 A1 | 6/1995 | (EP) . |
| 1024000 | 3/1966 | (GB) . |

OTHER PUBLICATIONS

Progress Lighting, PRO–OPTIC™.
Progress Lighting, P632–EB.
Progress Lighting, P87–AT.
Progress Lighting, Product Catalog, 262–280.

*Primary Examiner*—Ramon O. Ramirez
(74) *Attorney, Agent, or Firm*—Fish & Richardson, P.C.

(57) ABSTRACT

A socket housing that is designed to be mounted on a reflector includes a socket plate having generally L-shaped plate having a tab extending from an end of a first segment of the L-shaped plate and an enclosure including a pair of side walls. A first side wall includes a slotted opening that receives the tab when the socket plate is mounted on the enclosure.

25 Claims, 15 Drawing Sheets

FIG. 3
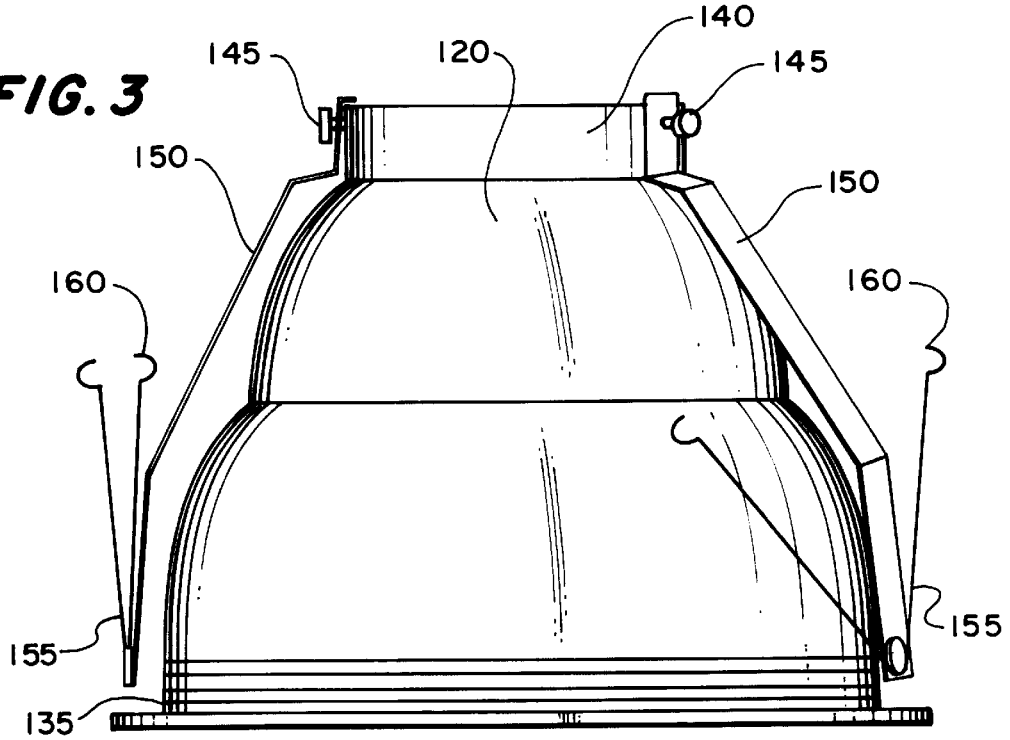
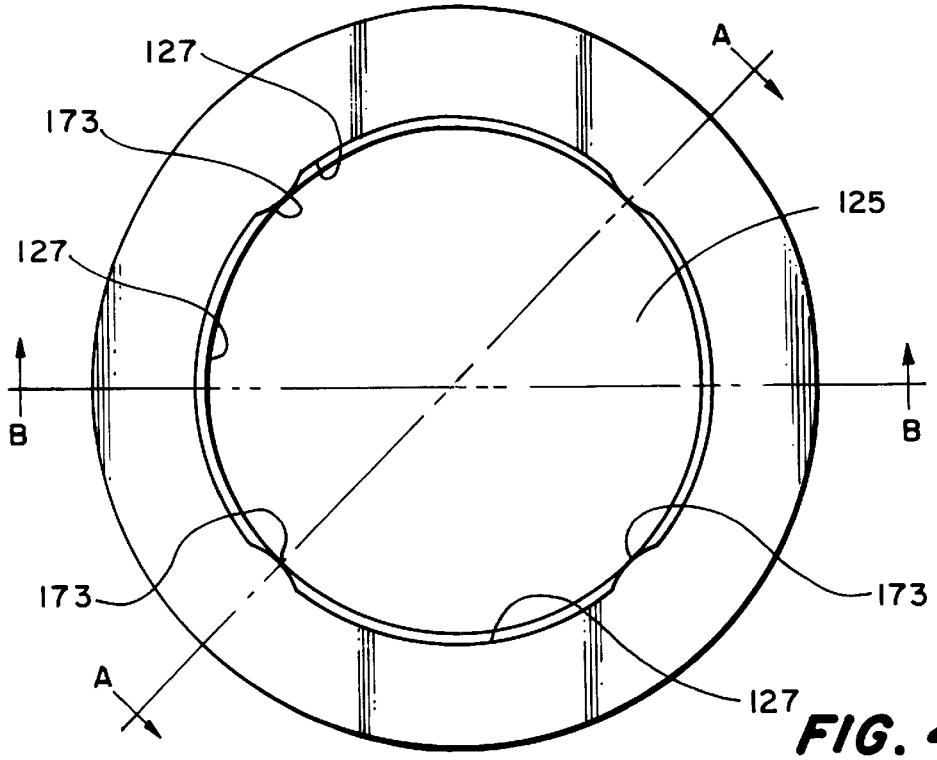
FIG. 4

HORIZONTAL SOCKET HOUSING ASSEMBLY

TECHNICAL FIELD

This invention relates to recessed lighting fixtures.

BACKGROUND

A typical recessed lighting fixture includes a frame, a reflector, a junction box and structure for attaching the frame to the ceiling. The frame includes an opening through which the reflector is inserted to direct light to an area below the lighting fixture. The reflector may be, for example, a wall-wash reflector or a down-wash reflector.

The wall-wash reflector directs the light down at an angle away from the lighting fixture. The down-wash reflector directs the light down from the lighting fixture. Different mechanisms can be used to retain the reflector in the frame. For example, the reflector may have an opening with a circumference that is larger than the opening in the frame. In such a configuration, the reflector sits on the top surface of the frame and surrounds the opening.

The junction box is an enclosure mounted on the frame that functions as a receptacle for joining the wires from an electrical power source and a lamp socket in the reflector. The junction box has walls with pry-out plates to receive the wires. The frame may be mounted to the ceiling using known techniques. For example, the frame may include a barbed insert that can be nailed into a wooden beam in the ceiling.

SUMMARY

In one general aspect, a socket housing configured to be mounted to a reflector includes a socket plate and an enclosure. The socket plate includes a generally L-shaped plate with a tab extending from an end of a first segment of the L-shaped plate. The enclosure includes a pair of side walls. A first side wall includes a slotted opening configured to receive the tab when the socket plate is mounted on the enclosure.

The socket housing may include one or more of the following features. For example, the enclosure may include a second side wall that is parallel to a second segment of the L-shaped plate when the socket plate is mounted on the enclosure. The second segment of the L-shaped plate and the second side wall may include openings that are aligned when the socket plate is mounted on the enclosure. The socket housing may further include a cable connector inserted through the openings to secure the L-shaped plate to the enclosure. The cable connector may be twisted or screwed into the openings. The cable connector may be keyed with at least one slot in the opening in the L-shaped plate and at least one slot in the opening in the second side wall to secure the L-shaped plate to the enclosure.

The enclosure may include a spring that is configured to be inserted into a slot in the reflector when the socket housing is mounted to the reflector. The enclosure may include a pair of side walls and each side wall may include an extension from which extends a tab. Mounting the socket housing to the reflector may include resting the tabs against an opening in the reflector. The enclosure may include a lower wall having a shaped edge configured to be flush against the reflector when the socket housing is mounted on the reflector. The enclosure may include at least one wall having at least one opening configured to release heat from the enclosure.

The first segment of the L-shaped plate may include at least one large diameter opening and at least two small diameter openings on opposite sides of the large diameter opening. The socket may includes pins that are received in the small diameter openings and wires that are passed through the large diameter opening. The first segment of the L-shaped plate may be configured to receive multiple sockets. To this end, the first segment may include three large diameter openings and five pairs of small diameter openings with each pair positioned on opposite sides of the large diameter openings. Pins of the sockets are received in the small diameter openings and wires are passed through the large diameter openings.

The enclosure may include an opening defined by the side walls, an upper wall and a lower wall, and the reflector may include an opening configured to mate with the opening of the enclosure.

In another general aspect, a socket plate is mounted on a socket housing that is configured to be mounted on a reflector. A socket housing including a first wall having a slotted opening is provided along with a generally L-shaped socket plate that includes a tab extending from a first segment of the plate and configured to be inserted into the slotted opening. The socket plate is mounted in the socket housing, and the socket housing is mounted in the reflector.

Embodiment may include one or more of the following features. For example, mounting the socket plate in the socket housing may include placing a second segment of the socket plate against a second wall of the socket housing and inserting the tab into a slotted opening in the first wall. Mounting the socket plate in the socket housing also may include aligning an opening in the second segment with an opening in the second wall. A cable connector may be installed in the openings.

Mounting the socket housing to the reflector may include placing a spring that extends from the socket housing into a slot in the reflector. Mounting the socket housing to the reflector may further include placing a pair of tabs that extend from the first wall and the second wall of the socket housing against an opening of the reflector.

Providing a socket plate may include providing a socket plate having at least one large diameter opening and at least one small diameter opening. A socket having electrical wires and a pin configured to be inserted into the small diameter opening may be mounted on the socket plate by inserting the pin into the small diameter opening.

The socket plate also may include three large diameter openings and at least three small diameter openings. Mounting the socket to the socket plate may include mounting three sockets to the small diameter openings. The socket plate also may include two rows of small diameter holes positioned on opposite sides of the large diameter openings.

The horizontal socket housing provides numerous advantages. For example, the housing can accommodate different lamp sources and more than one lamp. For example, the housing may accommodate one, two, or three lamps. The socket bracket is secured in the housing using a simple tongue and groove system, which eliminates the need for fasteners. The housing itself is easily mounted to the reflector using a positive spring retention system and a pair of tabs that rest against an opening in the reflector.

Other features and advantages will be apparent from the following description including the drawings, and from the claims.

DESCRIPTION OF DRAWINGS

FIG. 3 is a side view of a reflector of the lighting fixture of claim 1.

FIG. 4 is a top view of a noncircular aperture of the universal frame of FIG. 2.

Like reference symbols in the various drawings indicate like elements.

DETAILED DESCRIPTION

Figure 1:
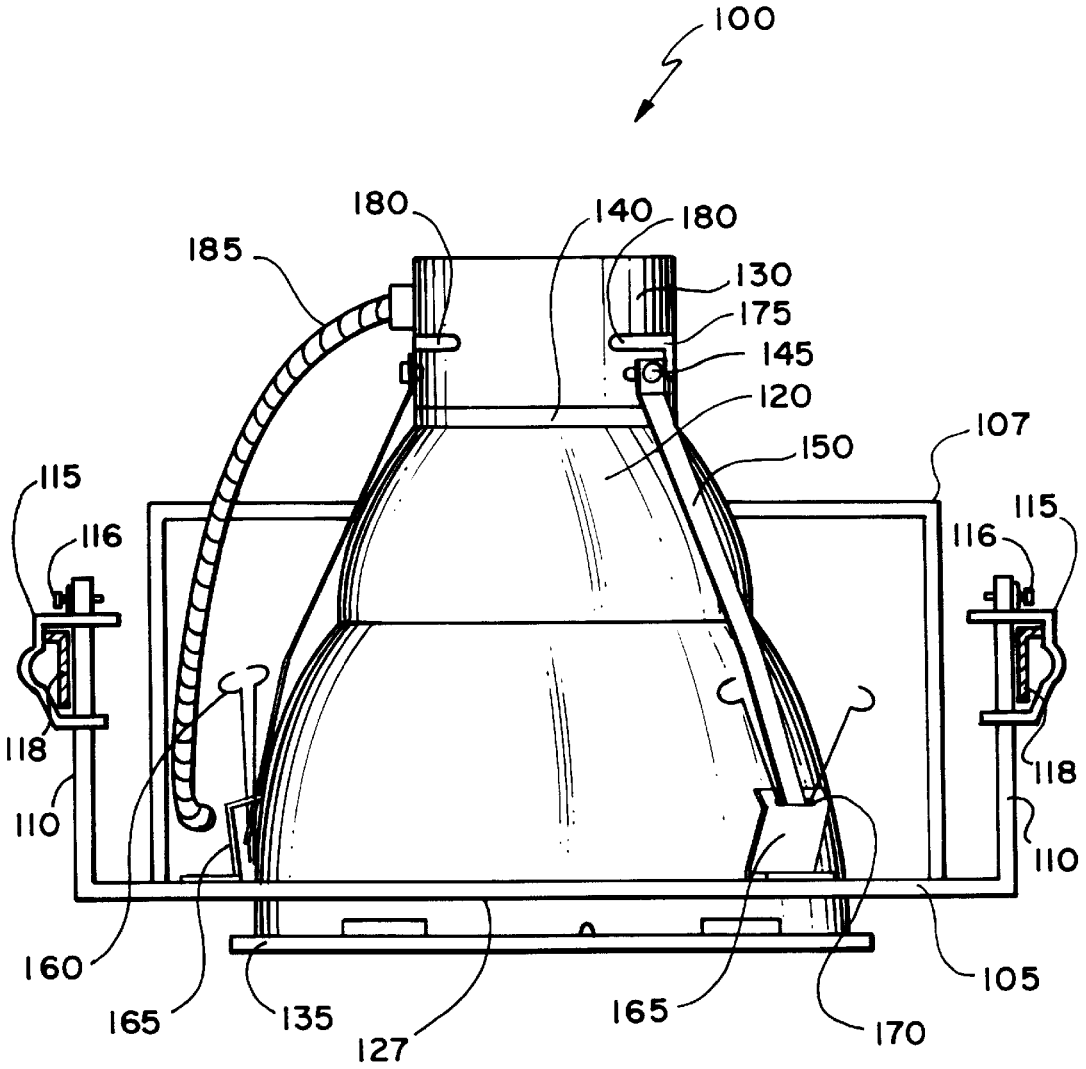
FIG. 1 is a side view of a recessed lighting fixture with a universal frame and hanger bar assembly.
Figure 2:
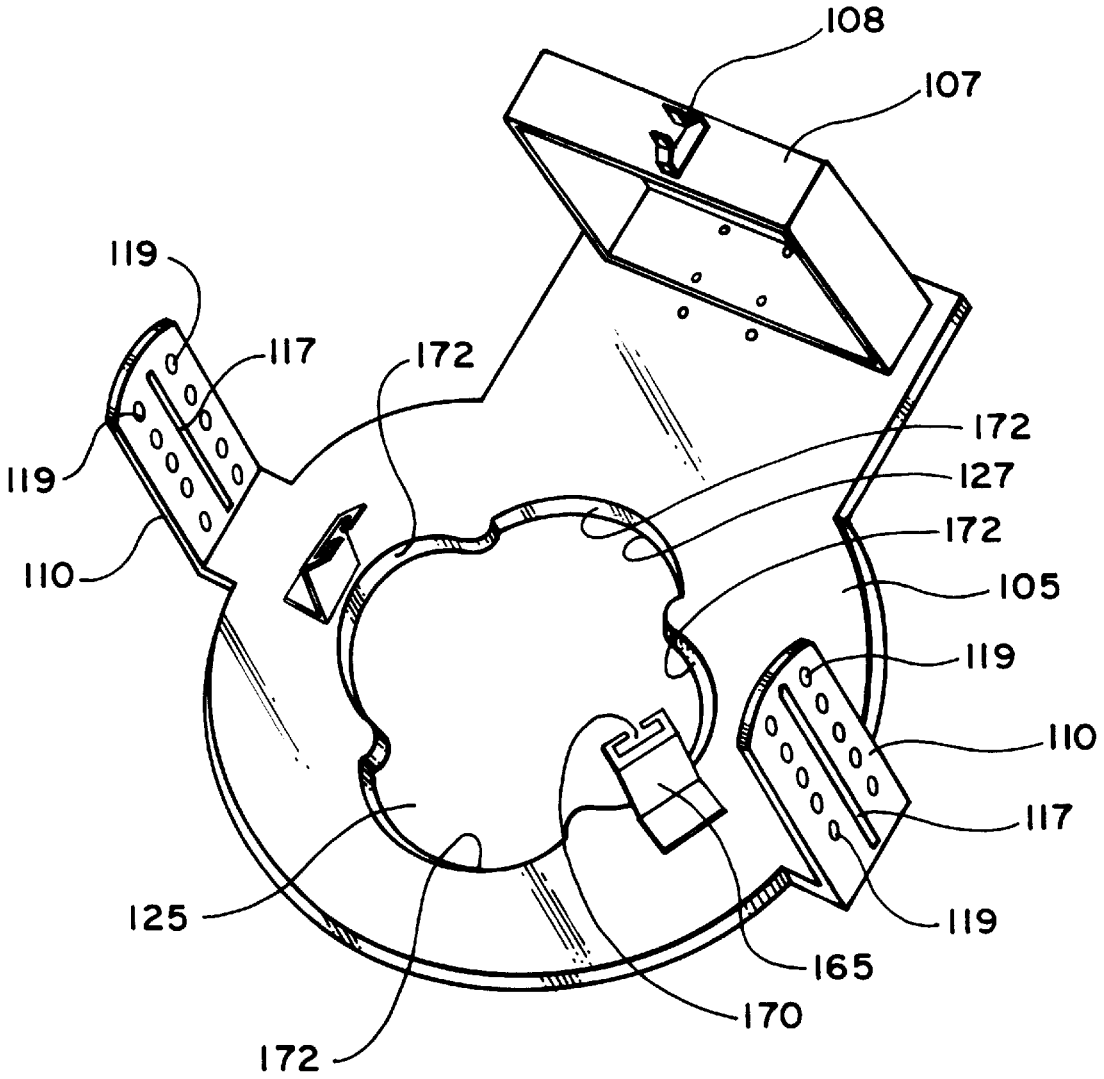
FIG. 2 is a perspective view of the universal frame of the lighting fixture of FIG. 1.

Referring to FIGS. 1–3, a recessed lighting fixture 100 includes a universal frame 105 that has a junction box 107 with a junction box spring 108. The fixture 100 also includes a pair of hanger bar mounts 110 to which a pair of hanger bar brackets 115 are slidably attached by screws 116 passing through slots 117 in the mounts 110. An L-shaped hanger bar 118 is slidably installed between each hanger bar mount 110 and the corresponding hanger bar bracket 115.

The position of the hanger bar mounts 110 relative to the hanger bar brackets 115 can be adjusted to adjust the height of the recessed lighting fixture in the ceiling. A series of holes 119 on opposite sides of the slots 117 are used to provide a scale for ensuring that the hanger bar brackets 115 are at the same relative position on the hanger bar mounts. The spacing between holes 119 on opposite sides of the slots 117 can be made such that opposite holes 119 are at the same height or are offset at slightly different heights. For example, opposite holes can be offset by one hole diameter. Using such a hole spacing provides more exact positioning of opposite brackets 115 by permitting the position of each bracket to be adjusted to within a hole diameter.

A reflector 120 is installed in the frame 105 through an aperture 125, which has a lip 127 that protrudes perpendicularly below the aperture and encircles the circumference of the aperture 125. The reflector 120 includes a socket 130, a trim body 135, and an upper ring 140. The upper ring 140 includes a pair of rivets 145 that attach a pair of metal bands 150 to the upper ring 140. Each metal band 150 includes a torsion spring 155 having opposing arms 160.

The reflector 120 is retained in the frame 105 by the interaction of the torsion spring arms 160 with a pair of mounting ears 165, each of which has a slotted channel 170. First, the reflector 120 is inserted into the aperture 125 such that the trim body 135 rests against the lip 127. The opposing arms 160 then are inserted into the slotted channel 170 by pulling the arms together and releasing them when they are in the slotted channel. The opposing arms 160 are kept together in the slotted channel 170, although the torsion spring 150 resists placing the arms in such proximity. The resistance to being kept together, which tends to cause the arms 160 to move apart, pulls the reflector 120 into the aperture until the trim body 135 rests against the lip 127. Retaining the reflector in this manner causes the trim body 135 to be flush with the ceiling in which the recessed lighting fixture is installed. The mounting ears 165 and the torsion springs 155 are keyed apart at the same angle, such as 150°, to eliminate misinstallation of the trim body 135.

Figure 5:
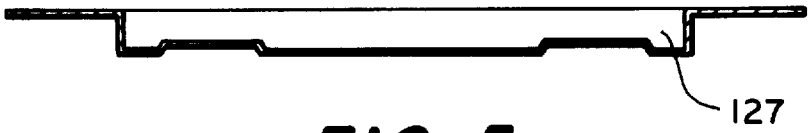
FIG. 5 is a sectional side view of the noncircular aperture of FIG. 4 taken along section lines 5—5.
Figure 6:
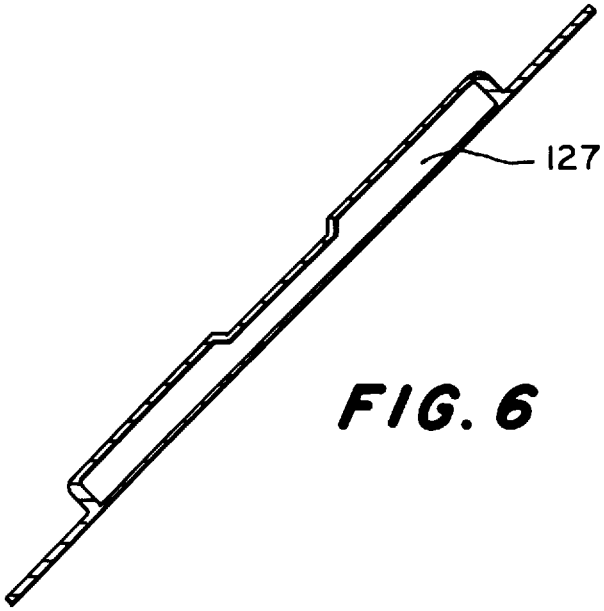
FIG. 6 is a sectional side view of the noncircular aperture of FIG. 4 taken along section lines 6—6.

Referring also to FIGS. 4–6, the aperture 125 has four or more lobes 172 that cause the aperture to be noncircular. Each lobe 172 is separated from the adjacent lobe 172 by a portion 173 that protrudes into the aperture 125. The noncircular aperture 125 and the frame 105 simulate existing die cast frames with the indented details on those frames. The aperture 125 accepts existing or new finishing sections. For example, the aperture can accept round or elliptical reflectors.

Figure 7:
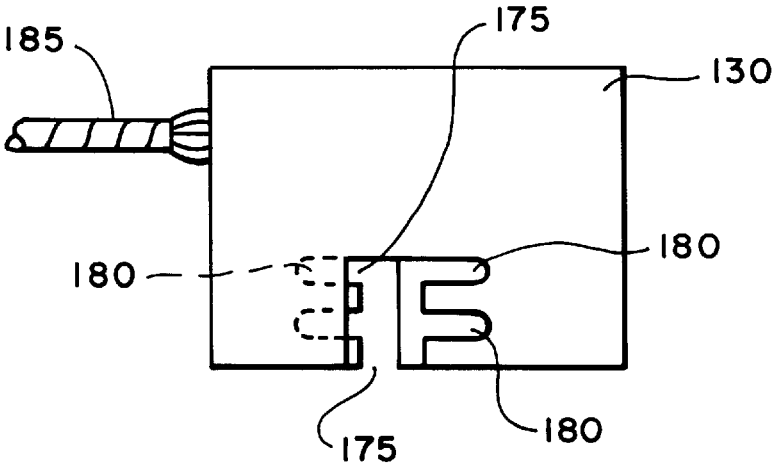
FIG. 7 is a side view of a socket of the lighting fixture of FIG. 1.

Referring to FIG. 7, the socket 130 includes a pair of vertically slotted channels 175, each of which opens to a pair of offset, horizontally slotted channels 180. During installation, the socket 130 is placed around the upper ring 140, the vertical slotted channels 175 are passed over the rivets 145, and the socket is turned clockwise to entrap the rivets 145 in the horizontally slotted channels 180. The horizontally slotted channels 180 are offset so that the socket height can be adjusted relative to the reflector 120, for example, to accommodate different types of lighting, such as incandescent, fluorescent, and metal halide bulbs. A conduit 185 contains wires that supply electrical power to the socket 130 and the bulb (not shown).

Figure 8:
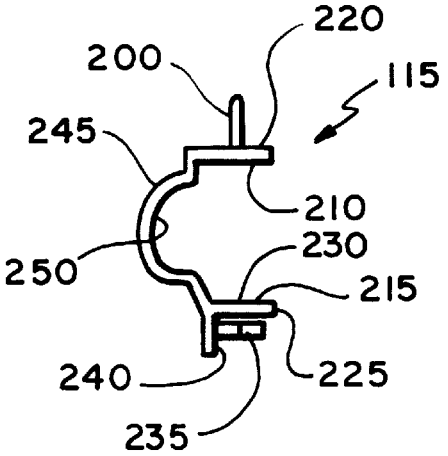
FIGS. 8–10 are side, front, and top views, respectively, of a hanger bar bracket of the lighting fixture of FIG. 1.
Figure 9:
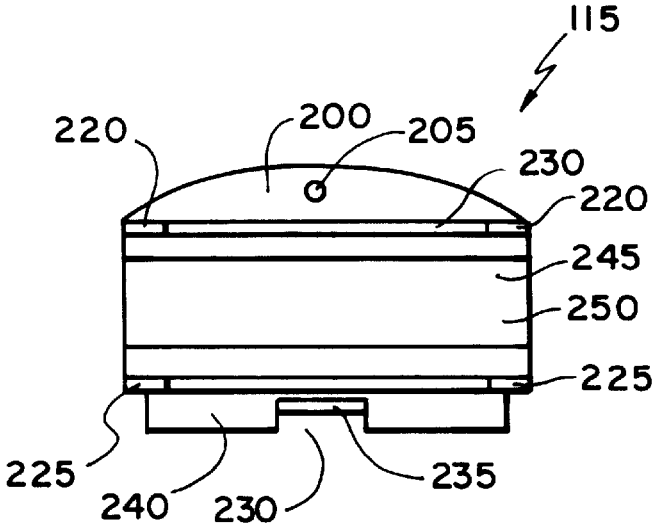
Figure 10:
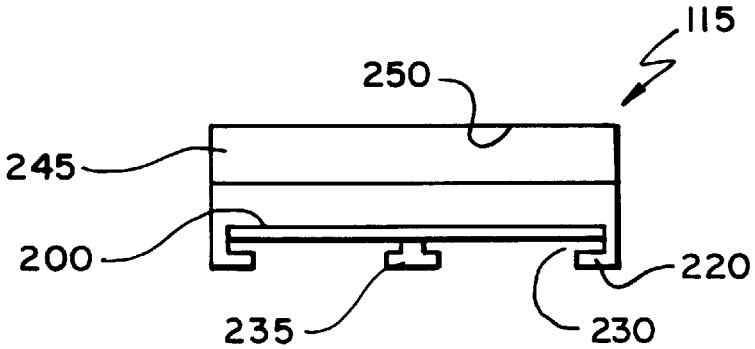

Referring to FIGS. 8–10, the hanger bar mounts 110 and the hanger bar brackets 115 are used to mount the recessed lighting fixture 100 to the hanger bars 118 or to a mounting conduit (not shown) recessed in a ceiling. Each hanger bar bracket 115 includes an upper vertical plate 200 that includes a threaded channel 205 through which the screw 116 (FIG. 1) is threadably attached to hold the bracket 115 to the hanger bar mount 110. When the bracket 115 is mounted to the hanger bar mount 110, the upper plate 200 is parallel to and flush with the hanger bar mount 110.

Each bracket 115 also includes an upper horizontal plate 210 and a parallel, lower horizontal plate 215. Two L-shaped tabs 220 extend from the upper horizontal plate 210 and two L-shaped tabs 225 extend from the lower horizontal plate 215. Each pair of tabs 220, 225 forms an opening 230 that is partly enclosed on two sides by the L-shaped tabs. An alignment tab 235 extends from a lower vertical plate 240 and is inserted into slot 117 of the hanger bar mount 110 when the bracket 115 is mounted on the hanger bar mount. Like upper vertical plate 200, the lower vertical plate 240 is parallel to and flush with the hanger bar mount 110 when the bracket is mounted to the mount.

To mount a hanger bar 115 bracket to a mount 110, the bracket is passed over the mount 110 through the opening 230 in the bracket, such that the tabs 220, 225 are on one side of the mount and the vertical plates 200, 240 are on the other side of the mount. The interaction between the alignment tabs 235 and the slots 117, and between the tabs 220 and 225 and the mounts keeps the brackets aligned and self-centered with the mount, and prevents the bracket from moving away from the mount.

Figure 11:
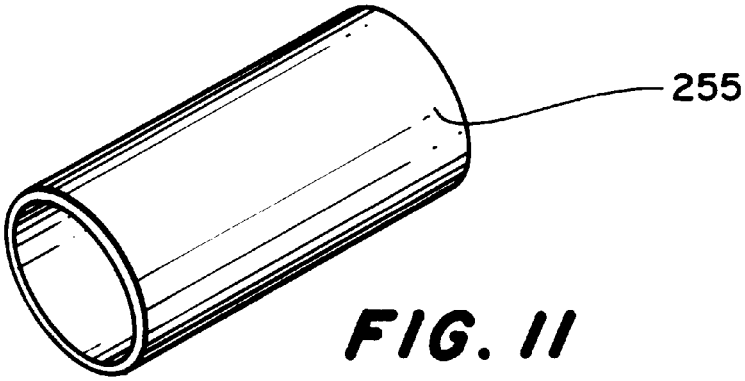
FIG. 11 is a perspective view of a mounting conduit.
Figure 12:
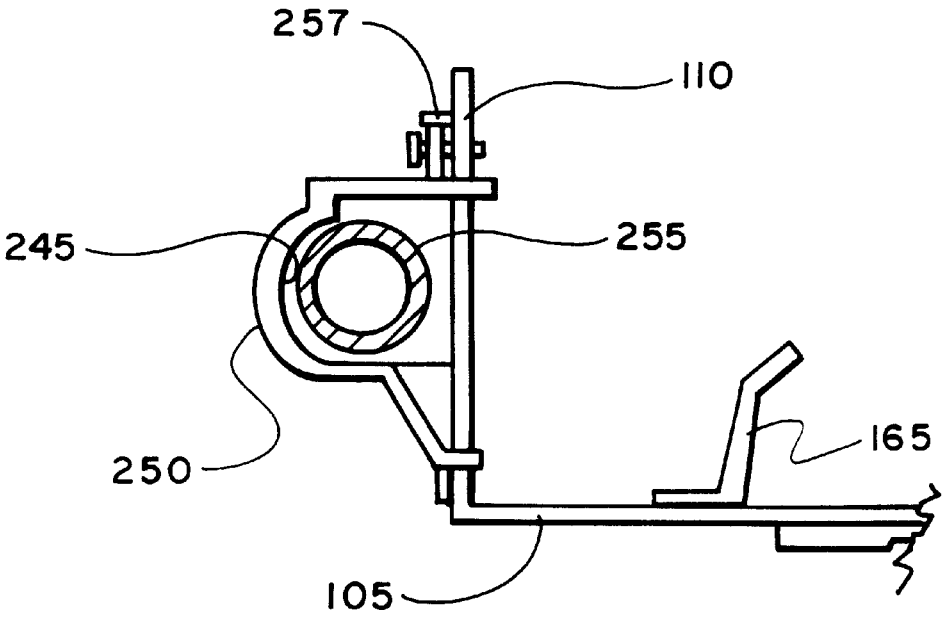
FIG. 12 is an end view of the mounting conduit of FIG. 11 mounted in the hanger bar bracket of FIGS. 8–10.
Figure 13:
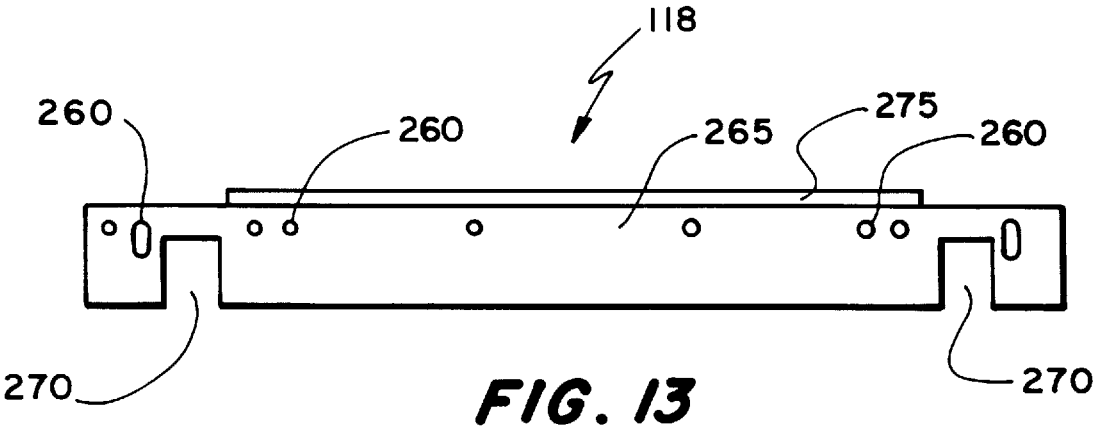
FIGS. 13 and 14 are front and side views, respectively, of a hanger bar.
Figure 14:
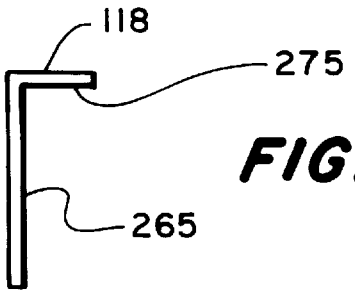
Figure 15:
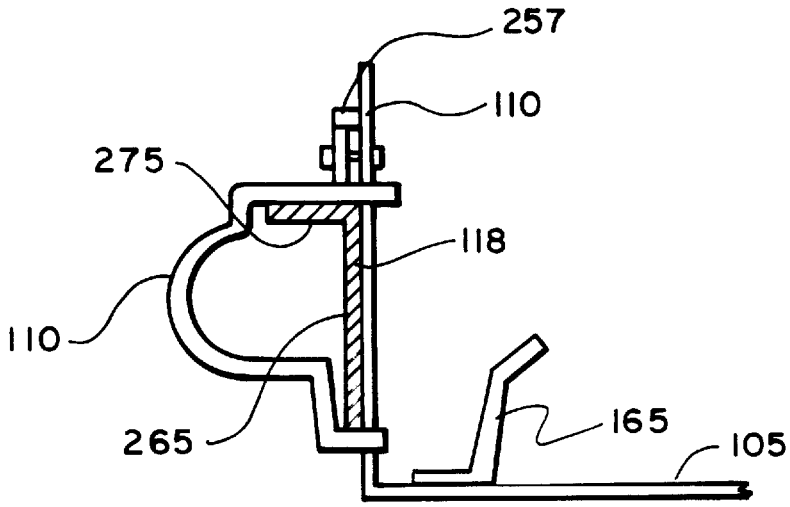
FIG. 15 is a side view of the hanger bar of FIGS. 13 and 14 mounted in the hanger bar bracket of FIGS. 8–10.

Referring also to FIGS. 11–15, each hanger bar bracket 115 also includes a shaped wall 245 that is shaped to permit the use of different configurations of hanging bars and mounting conduits within the bracket 115 when it is mounted to the mount 110. For example, the shaped wall 245 includes a rounded section 250 that permits the recessed lighting fixture 100 to be mounted in the ceiling using a round conduit 255 (FIGS. 11 and 12). The relatively longer length of upper horizontal plate 210, compared to the length of lower horizontal plate 215, is such that the L-shaped hanger bar 118 fits securely within the bracket 115 without excessive play (FIGS. 13–15). A pair of tabs 257 extend from each hanger bar mount 110 and limit upward movement of the hanger bar bracket 115 by acting as a stop for the upper vertical plate 200. When the hanger bar brackets are mounted to the mounts during manufacturing, the brackets can be set in position against the stops. With this positioning, the frame can be mounted in the ceiling without the installer needing to adjust the brackets.

The hanger bar 118 includes mounting holes 260 passing through a vertical section 265, a pair of indentions 270, and a horizontal edge 275. The hanger bar 118 can be bent at the indentions 270 to provide a more secure mounting to a T-bar (not shown).

Figure 16:
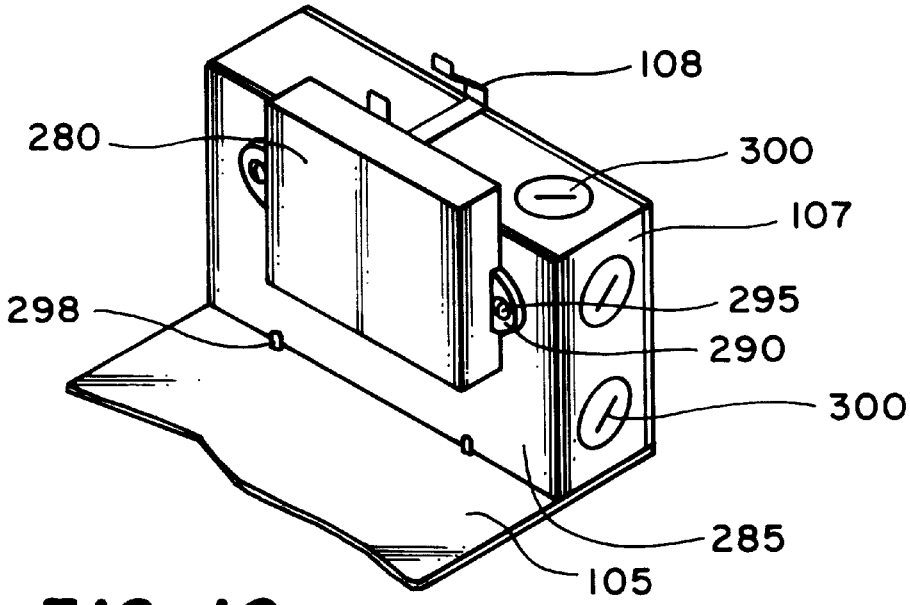
FIGS. 16 and 17 are perspective views of a junction box to which is attached a ballast for, respectively, fluorescent lighting and high intensity discharge lighting.
Figure 17:
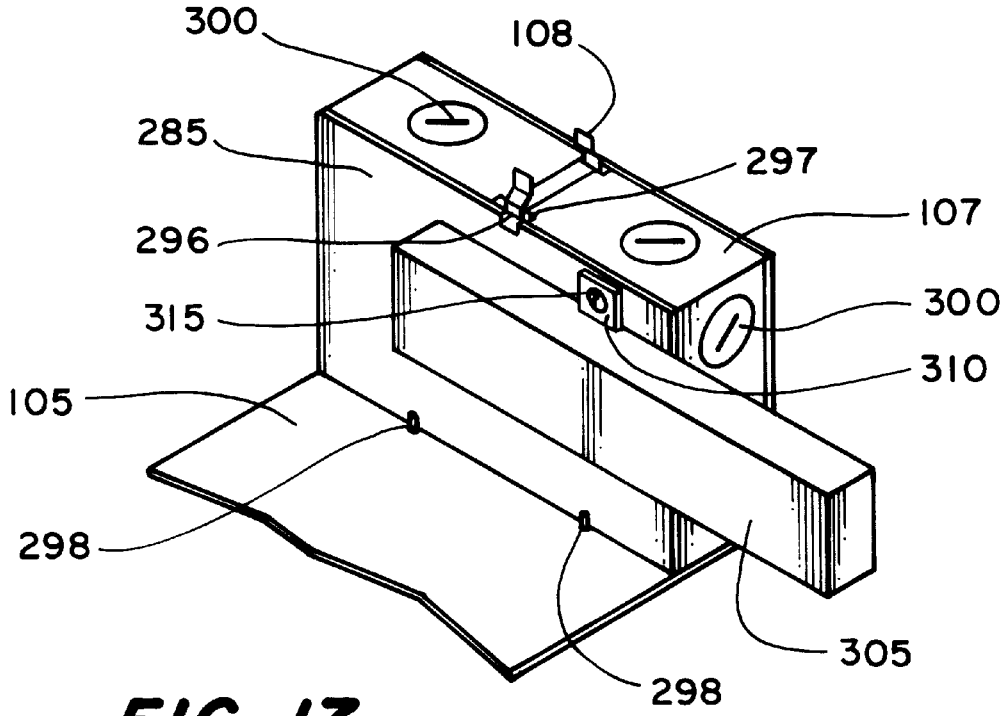

Referring to FIGS. 16 and 17, the junction box spring 108 is recessed over the junction box rather than extending beyond the junction box. This permits the junction box 107 to accommodate a variety of ballasts and transformers. For example, FIG. 16 illustrates a ballast 280 for fluorescent lighting that is mounted on a plate 285 by threadably attaching tabs 290 to the plate using screws 295.

The junction box spring 108 retains the plate 285 on the junction box 107 by clipping a bend 296 of the junction box spring over the edge of the plate. The bend 296 extends downward through a slot 297 in the top of the junction box. Two protrusions 298 on the frame 105 limit the outward movement of the bottom of the plate 285. One or more similar protrusions on the other side of the plate 285 limit the inward movement of the bottom of the plate. The combination of the protrusions 298 and the bend 296 retain the plate 285 against the junction box. Pry-out plates 300 are removable to insert wiring, into the junction box to provide power to the ballast.

FIG. 17 illustrates a ballast 305 for high intensity discharge lighting mounted on a plate 285 by flexibly attaching tabs 310 to the plate using a screw 315. The plate 285 is retained on the junction box 107 by clipping it under the junction box spring 108. A transformer also can be mounted on the plate 285 and power can be provided through the transformer to step down the voltage from, for example, 277 volts to 120 volts.

Figure 18:
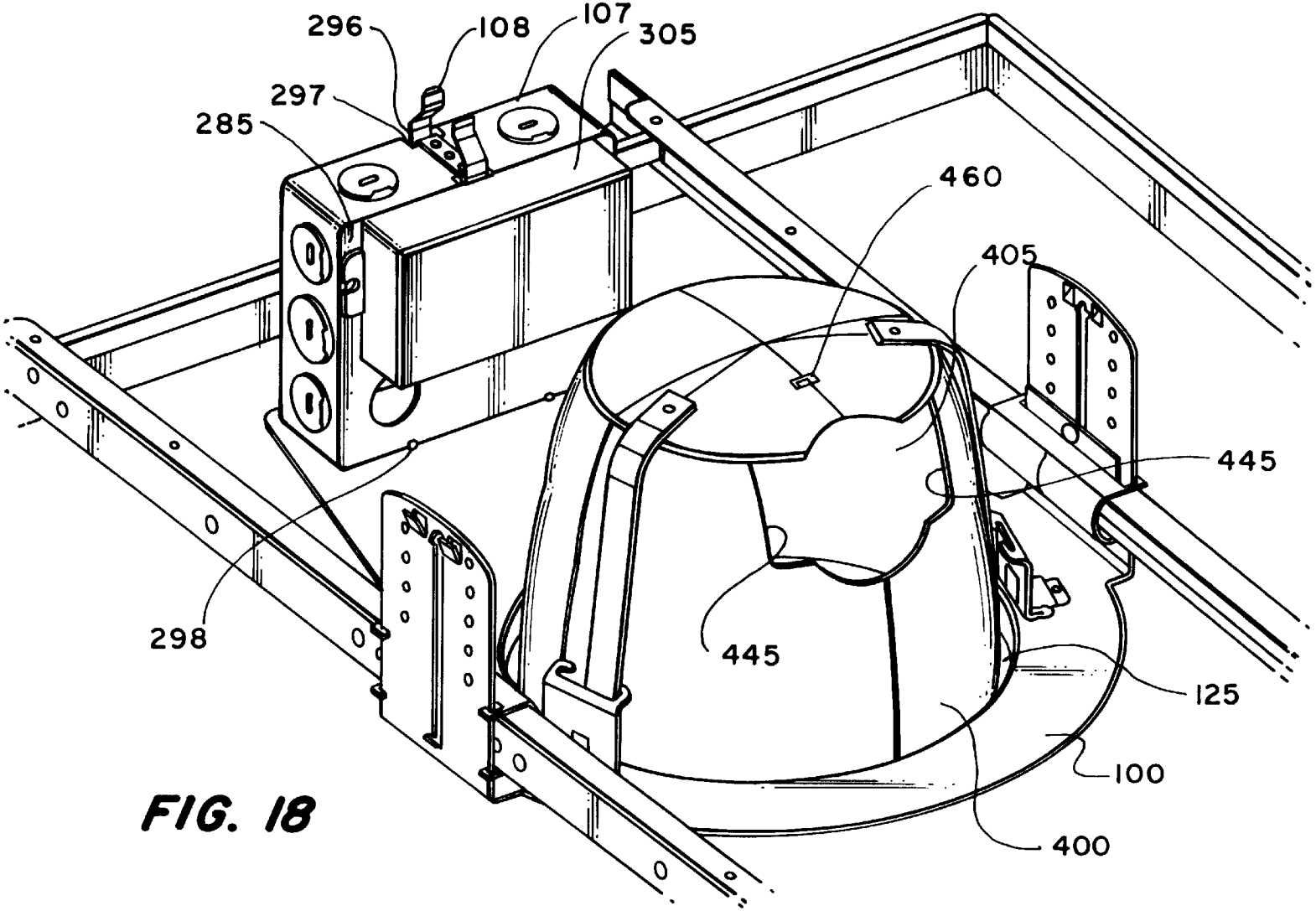
FIG. 18 is a perspective view of the recessed lighting fixture of FIG. 1 in which the reflector is configured to receive a horizontal socket housing assembly.
Figure 19:
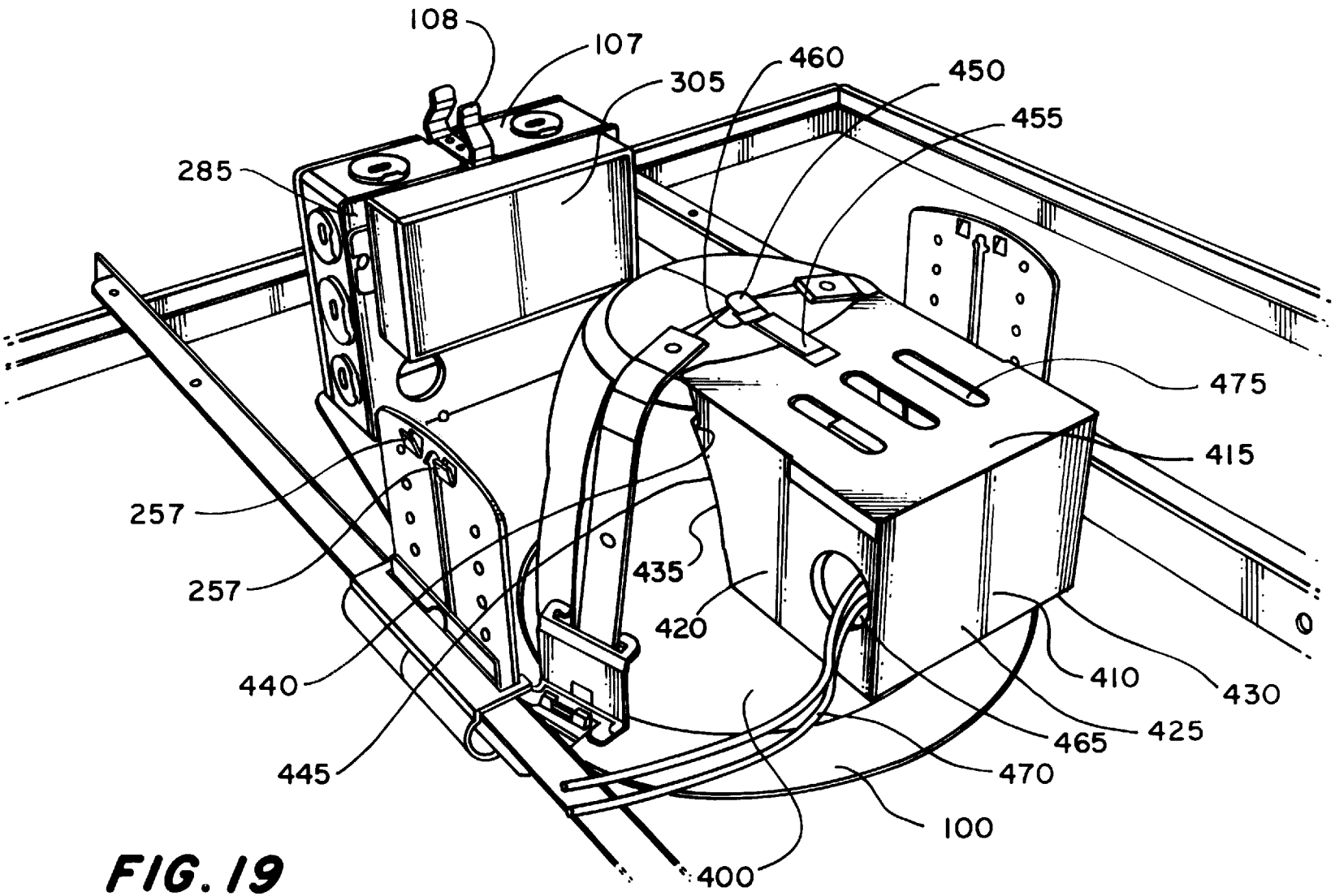
FIG. 19 is a perspective view of the recessed lighting fixture of FIG. 18 in which a horizontal socket housing assembly is mounted to the reflector.

Referring to FIGS. 18 and 19, the recessed light fixture 100 includes a reflector 400 mounted through the noncircular aperture 125 and the ballast 305 mounted on the junction box 107. The reflector 400 includes an opening 405 configured to receive a horizontal socket housing 410. The horizontal socket housing 410 includes an upper wall 415, a pair of side walls 420, a rear wall 425, a bottom wall 430, and an opening 435. The opening 435 mates with the reflector's opening 405 when the horizontal socket housing 410 is mounted on the reflector 400. To mount the socket housing 410 on the reflector 400, the socket housing opening 435 is placed adjacent to the opening 405, such that a pair of wall extensions, each having a tab 440, are securely positioned adjacent to a pair of vertical walls 445 defining opposite sides of the opening 405. A spring tongue 450, which is mounted on the socket housing 410 by a rivet 455, fits within a rectangular groove 460 on the top of the reflector 400. A positive spring retention system assembly also can be used to mount the socket housing on the reflector. The socket housing 410 includes an opening 465 through which wires 470 pass to provide electrical power to a lamp socket (not shown) that is positioned within the socket housing 410. The socket housing also includes openings 475 through the upper wall 415 to provide a vent for heat generated by an energized lamp in the lamp socket.

Figure 20:
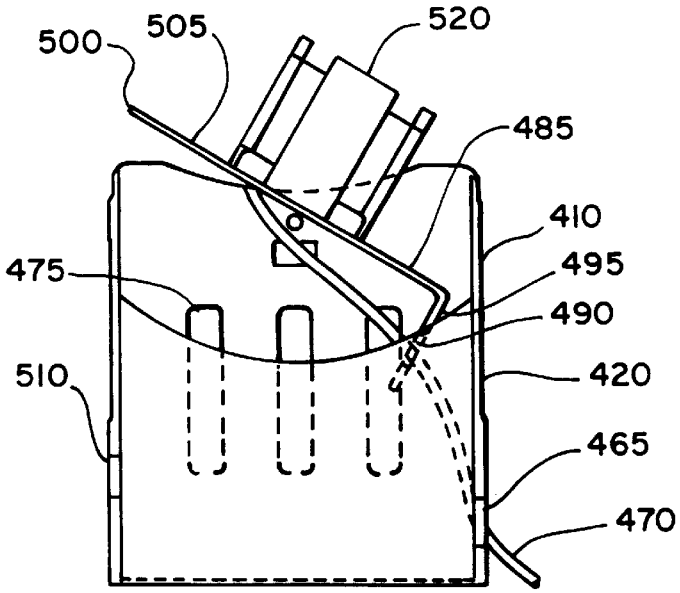
FIG. 20 is a side view of the socket housing assembly of FIG. 19 illustrating insertion of a socket plate.
Figure 21:
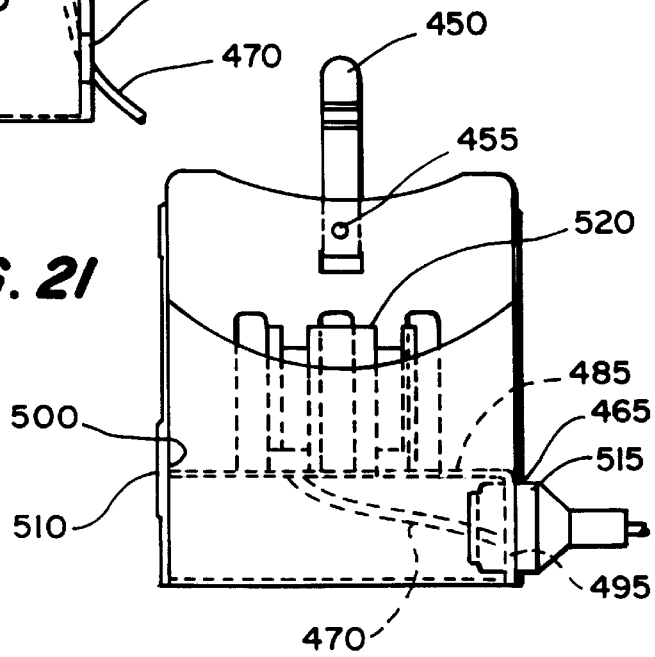
FIGS. 21 and 22 are side and perspective views of the socket housing assembly of FIG. 20 illustrating the socket plate installed in the socket housing assembly.
Figure 22:
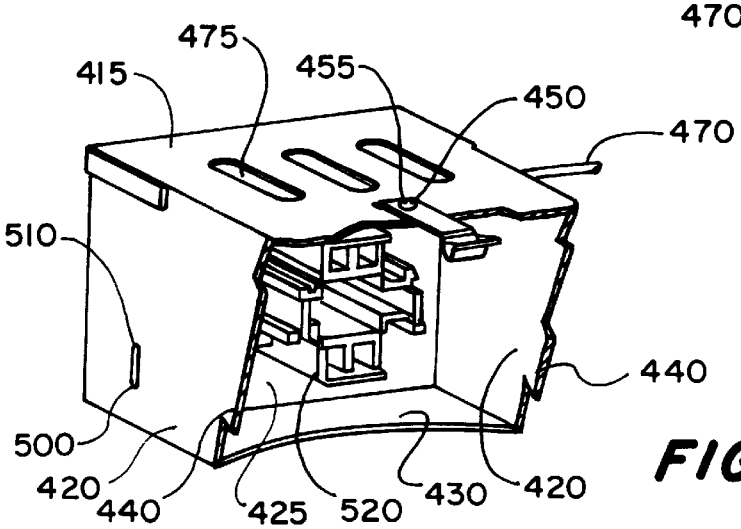

FIGS. 20–22 illustrate the installation of an L-shaped plate 485 in the socket housing 410. The electrical wires 470 pass through an opening 490 in a second segment 495 of the L-shaped plate 485, and out of the socket housing 410 through the opening 465. The L-shaped plate 485 is rotated such that the second segment 495 is placed adjacent to the side wall 420, which includes opening 465, with the opening 490 positioned adjacent to the opening 465. A bracket tab 500, extending from a first segment 505 of the L-shaped plate 485, then is inserted into a slot 510 to keep the plate securely positioned within the housing 410. A cable connector 515 is inserted through the openings 465 and 490, and clips into place, to keep the plate positioned within and mounted to the housing. The connector also may be twisted or screwed into place, or may be keyed with slots in the openings 465 and 490.

Figure 23:
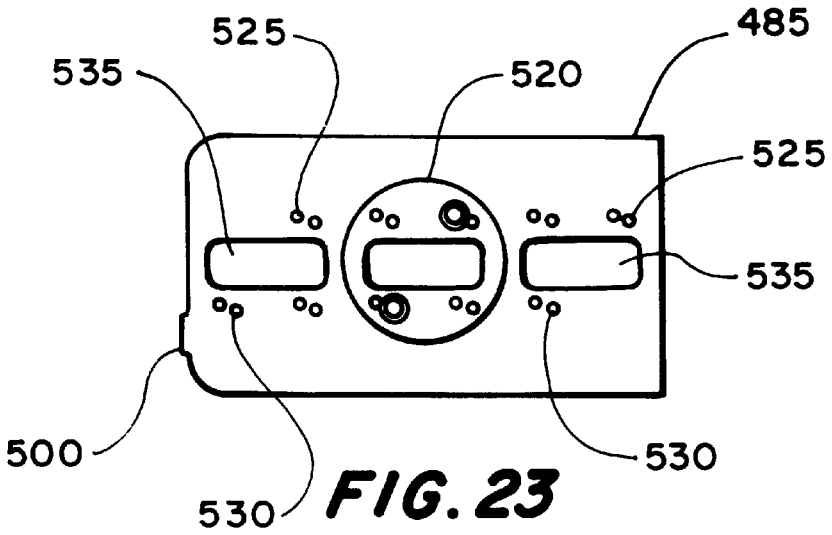
FIGS. 23–25 are front views of the socket plate of FIG. 20.
Figure 24:
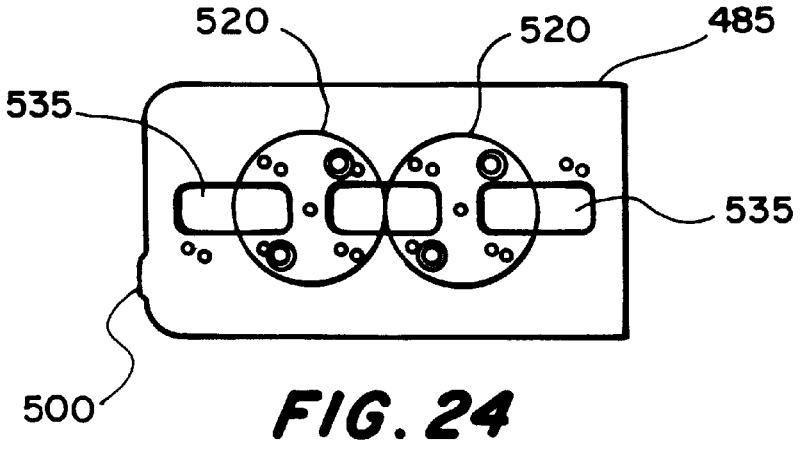
Figure 25:
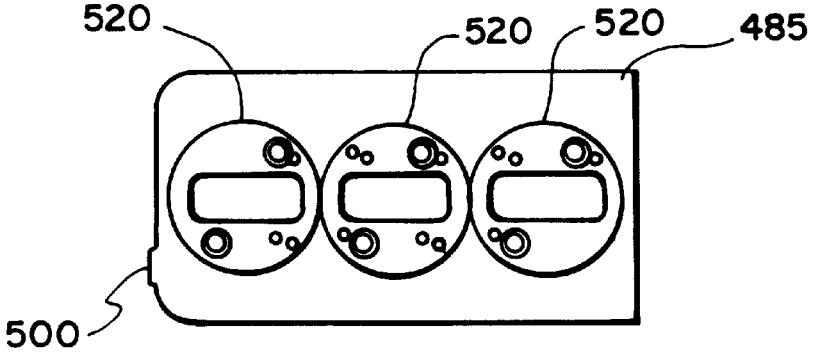
Figure 26:
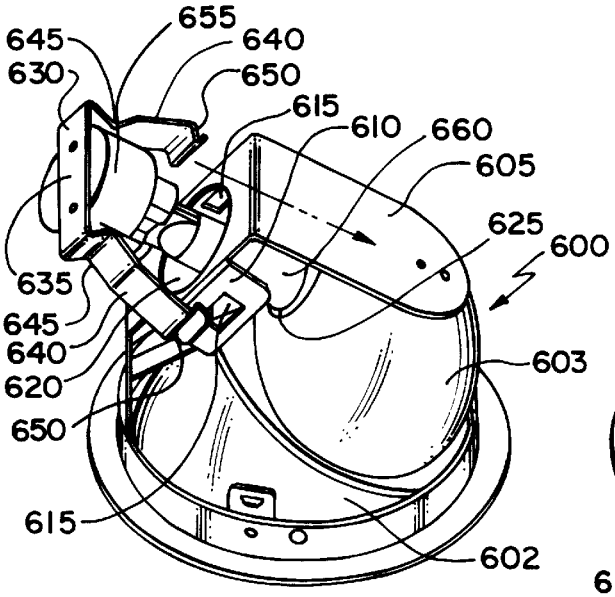
FIGS. 26 and 27 are perspective views of a wall-wash reflector system having a universal socket spring.
Figure 27:
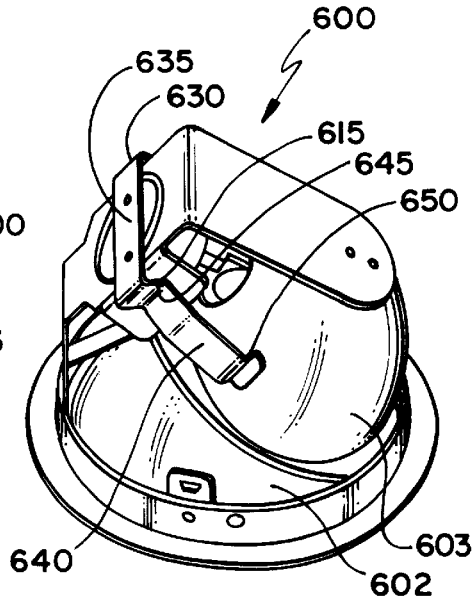
Figure 29:
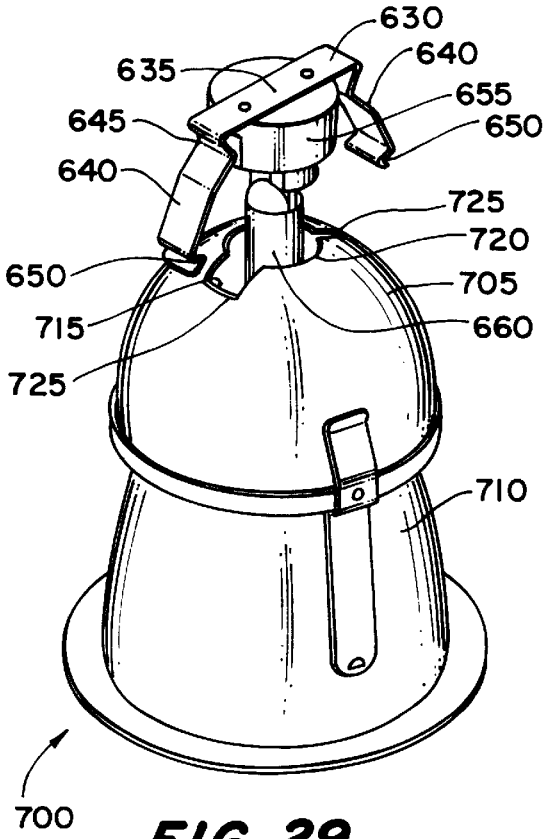
FIGS. 29 and 30 are perspective views of a down-light reflector system having the universal socket spring of FIGS. 26 and 27.

Referring to FIGS. 23–25, the L-shaped plate 485 includes a socket 520 into which a lamp may be inserted. One, two or three sockets 520 may be mounted on the L-shaped plate 485. The L-shaped plate 485 includes five upper pairs of holes 525 and five lower pairs of holes 530. The upper pairs of holes 525 are horizontally offset from the lower pairs of holes 530 and vertically separated by the slots 535. When one or more sockets 520 are mounted on the plate 485, the wires 470 pass through the slots 535.

To mount one socket on the plate 485 (FIG. 23), pins (not shown) extending from the back of the socket 520 are inserted into the middle pair of holes 525, 530. The pins may be retained in the holes 525, 530 by an interference fit, press fit or other mechanism. To mount two sockets 520 on the plate 485 (FIG. 24), pins extending from the back of the sockets are inserted into pairs of holes 525, 530 adjacent to the pair of middle holes 525, 530. To mount three sockets 520 to the plate 485 (FIG. 25), pins extending from the back of one socket 520 are inserted into the middle pair of holes 525, 530, and pins extending from the two adjacent sockets 520 are inserted into the pairs of holes 525, 530 on the ends. The holes into which the pins are inserted when two sockets 520 are used are left unused when three sockets 520 are used. The pairs of holes 525, 530 can be modified to be single holes or more than two holes, depending on the configuration of the socket. When lamps (not shown) are inserted into the sockets 520, and the socket housing 410 is mounted to the reflector 400, the lamps extend horizontally from the socket housing into the reflector.

Referring to FIGS. 26–29, a wall-wash, two piece reflector system 600 may be installed in the recessed lighting fixture 100. The reflector system includes a lower non-imaging parabolic reflector 602 and an upper elliptical reflector 603. A glass lens 604 is kept captive within the upper reflector 603. The wall-wash reflector 600 includes a mounting plate 605 riveted to the top of the upper reflector 603. A pair of tabs 610 extends from the plate 605 with each tab including a slot or opening 615. The plate 605 also includes an opening 620 aligned with an opening 625 in the top of the reflector 603.

A socket spring 630 for mounting on the reflector system 600 includes a base 635 from which extends a pair of arms 640. Each arm 640 includes an upper bend 645 and a lower bend 650. When the socket spring 630 is mounted on the mounting plate 605, the upper bend 645 on each arm 640 is inserted into one of the slots 615. A round socket 655 mounted on the base 635 fits securely within the opening 620 when the spring 630 is mounted on the plate 605. A lamp 660, such as a metal halide lamp, is mounted in the socket 655 and inserted through the openings 620 and 625. Although not shown in FIGS. 26–29, the reflector system 600, similarly to the reflector 120 of FIG. 1, may include metal bands 150 to which torsion spring arms 160 are attached. The reflector 600 may be mounted on the frame 105 with the torsion spring arms 160 mounted on the mounting ears 165.

Figure 30:
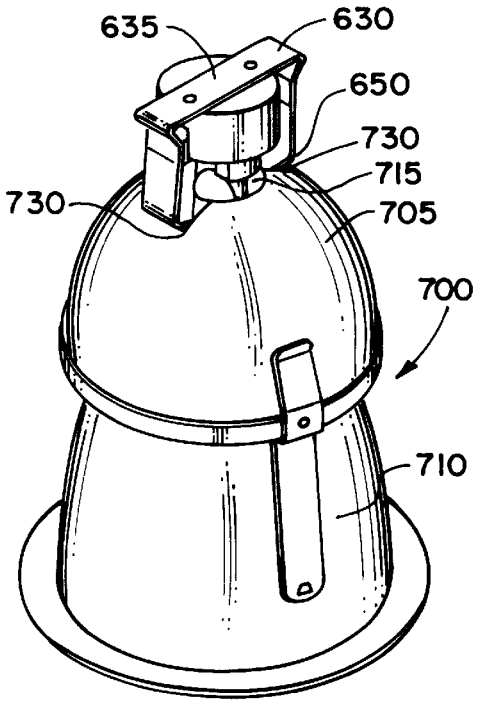
Figure 28:
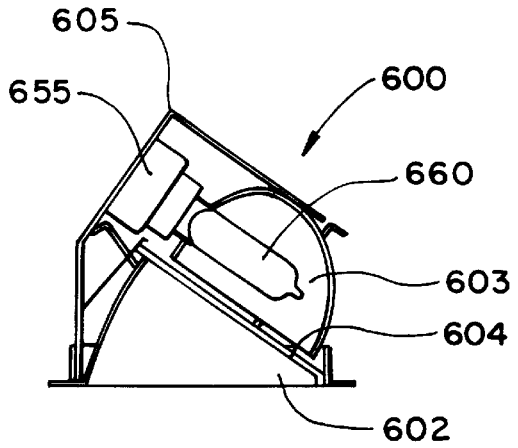
FIG. 28 is a cross-sectional view of the wall-wash reflector system of FIGS. 26 and 27.
Figure 32:
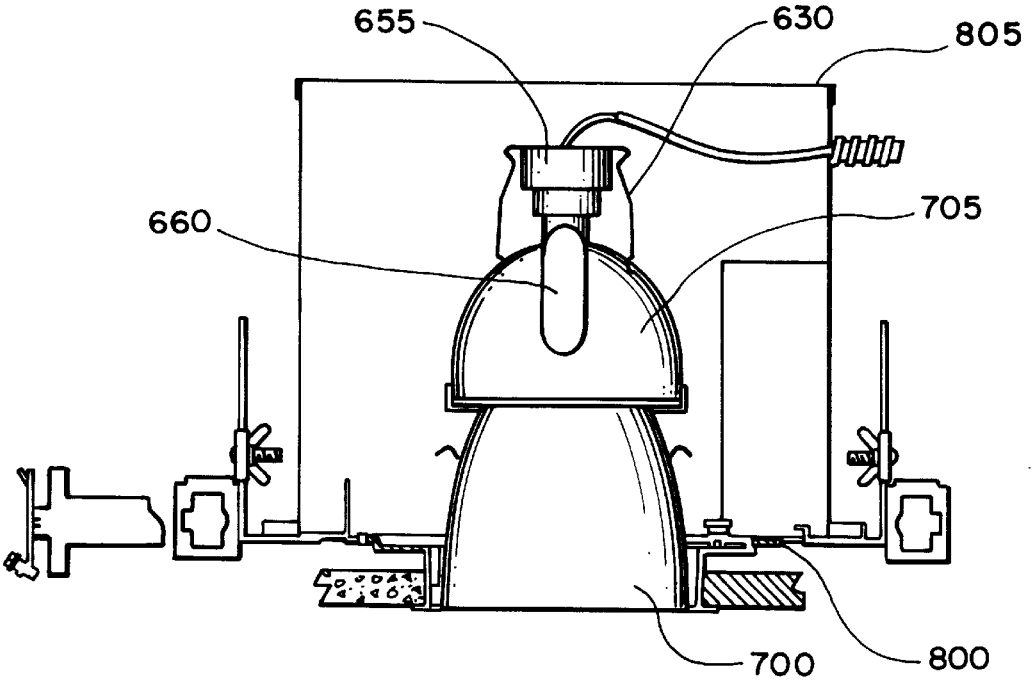
FIG. 32 is a cross-sectional view of the recessed lighting fixture of FIG. 31 with the down-light reflector system installed on the fixture.
Figure 31:
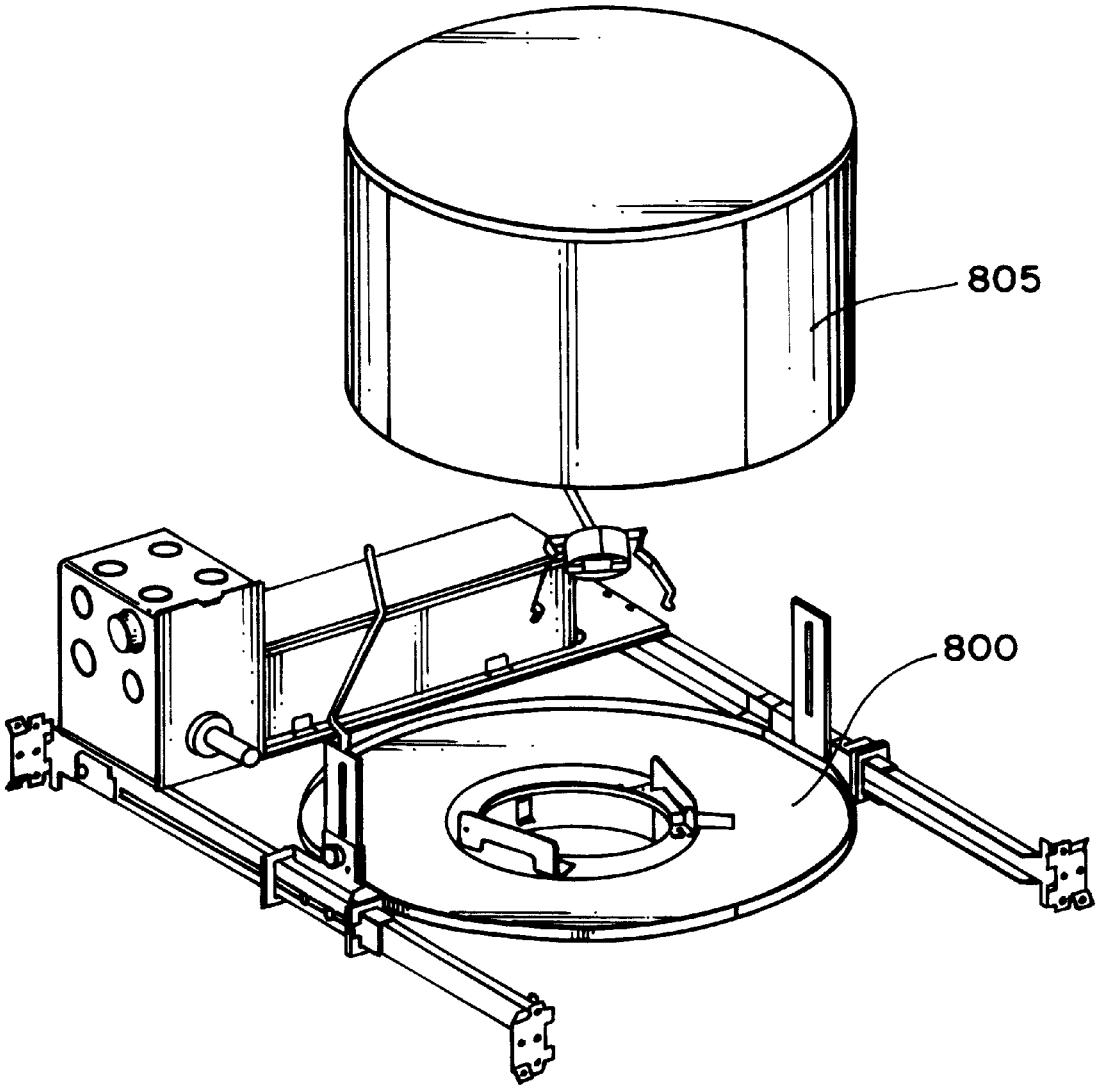
FIG. 31 is a perspective view of a recessed lighting fixture.

Referring to FIGS. 30–32, a down-wash reflector system 700 may be used with the recessed lighting fixture 100. The down-wash reflector system 700 includes an upper elliptical parabolic reflector 705 and a lower non-imaging parabolic reflector 710. A lens 712 is kept captive in the upper reflector 705. The upper reflector 705 includes an opening 715 into which the socket spring 630 is inserted. The opening 715 includes a circular portion 720 and a pair of slotted portions 725. To mount the socket spring 630, the arms 640 are pressed inward and the lamp 660 is inserted into the circular portion 720 of the opening 715 while at the same time the arms 640 are inserted into the slotted portions 725 of the opening 715. When the bends 650 are adjacent to the edges 730 of the slotted portions 725, the arms 640 are released such that the bends 650 press outwardly against the edges 730. The outward force of the arms 640 against the edges retains the socket spring 630 in the upper reflector 705. Like the wall-wash reflector system 600, the down-wash reflector system 700 can be mounted to the frame 105 with the metal bands 150 attached to the reflector system 700 and the attached torsion spring arms 160 mounted to the mounting ears 165.

The socket spring 630 can be modified to include additional pairs of bends to make the spring more universally applicable. For example, to use a longer lamp, the arms 640 may be longer and may include at least one pair of bends positioned beyond bends 650 so that the base 635 is further away from the reflector. The arms also may include bends spaced at relatively short intervals along their length so that the spring 630 can accommodate various bulbs and reflector systems.

The wall-wash reflector system 600 and the down-wash reflector system 700 can be mounted on the same frame 800 and can be enclosed by the same housing 805. The frame 800 may have many of the features of the recessed lighting fixture 100 described above. For example, to mount the frame in the ceiling, the frame 800 may include the hanger bar mounts and hanger bar brackets described above. The reflector system 700 or 800 may be mounted to the frame 800 using the torsion spring system described above. The frame 800 also may have the noncircular aperture described above.

Other embodiments are within the scope of the following claims.

What is claimed is:

1. A socket housing configured to be mounted on a reflector, the socket housing comprising:

a socket plate comprising a generally L-shaped plate having a tab extending from an end of a first segment of the L-shaped plate; and an enclosure including a pair of side walls, wherein a first side wall includes a slotted opening receiving the tab when the socket plate is mounted on the enclosure.

2. The socket housing of claim 1, wherein the enclosure includes a second side wall that is parallel to a second segment of the L-shaped plate when the socket plate is mounted in the enclosure.

3. The socket housing of claim 2, wherein the second segment of the L-shaped plate includes an opening, the second side wall includes an opening, and the openings are aligned when the socket plate is mounted on the enclosure.

4. The socket housing of claim 3, further comprising a cable connector inserted through the openings.

5. The socket housing of claim 4, wherein the cable connector secures the L-shaped plate to the enclosure.

6. The socket housing of claim 4, wherein the cable connector is twisted into the openings.

7. The socket housing of claim 4, wherein the openings in the L-shaped plate and the second side wall each include a slot and the cable connector includes a key oriented to fit within the slot.

8. The socket housing of claim 1, wherein the enclosure includes a spring that is configured to be inserted into a slot in the reflector when the socket housing is mounted on the reflector.

9. The socket housing of claim 1, wherein the enclosure includes a pair of side walls, each side wall includes an extension from which extends a tab, and the tabs rest against an opening in the reflector when the socket housing is mounted on the reflector.

10. The socket housing of claim 1, wherein the enclosure includes a lower wall having a shaped edge configured to be flush against the reflector when the socket housing is mounted to the reflector.

11. The socket housing of claim 1, wherein the enclosure includes at least one wall having at least one opening configured to release heat from the enclosure.

12. The socket housing of claim 1, wherein the first segment of the L-shaped plate is configured to receive multiple sockets.

13. The socket housing of claim 12, wherein the first segment includes at least one large diameter opening and at least two small diameter openings on opposite sides of the large diameter opening, and the socket includes pins configured to be received in the small diameter openings and wires configured to be passed through the large diameter opening.

14. The socket housing of claim 12, wherein the first segment includes three large diameter openings and five pairs of small diameter openings positioned on opposite sides of the large diameter openings, wherein the socket includes pins configured to be received in the small diameter openings and wires configured to be passed through the large diameter openings.

15. The socket housing of claim 1, wherein the enclosure includes an opening defined by the side walls and an upper wall and a lower wall, and the reflector includes an opening configured to mate with the opening of the enclosure.

16. A method of mounting a socket plate to a socket housing configured to be mounted to a reflector, the method comprising:

providing a socket housing including a first wall having a slotted opening;

providing a generally L-shaped socket plate that includes a tab extending from a first segment of the plate and configured to be inserted into the slotted opening;

mounting the socket plate in the socket housing; and mounting the socket housing in the reflector.

17. The method of claim 16, wherein mounting the socket plate in the socket housing comprises placing a second segment of the socket plate against a second wall of the socket housing and inserting the tab into the slotted opening in the first wall.

18. The method of claim 16, wherein mounting the socket plate in the socket housing comprises aligning an opening in the second segment with an opening in the second wall.

19. The method of claim 18, further comprising installing a cable connector in the openings.

20. The method of claim 16, wherein the socket plate includes at least one socket.

21. The method of claim 16, wherein mounting the socket housing to the reflector comprises placing a spring extending from the socket housing into a slot in the reflector.

22. The method of claim 21, wherein mounting the socket housing to the reflector further comprises placing a pair of tabs extending from the first wall and the second wall of the socket housing against an opening of the reflector.

23. The method of claim 16, wherein providing a socket plate comprises:

providing a socket plate having at least one large diameter opening and at least one small diameter opening;

providing at least one socket having electrical wires and a pin configured to be inserted into the small diameter opening; and mounting the socket to the socket plate by inserting the pin into the small diameter opening.

24. The method of claim 23, wherein the socket plate comprises three large diameter openings and at least three small diameter openings and mounting the socket to the socket plate comprises mounting three sockets to the small diameter openings.

25. The method of claim 24, wherein the socket plate includes two rows of small diameter holes positioned on opposite sides of the large diameter openings.

* * * * *